US008971746B2

(12) United States Patent
Hasegawa et al.

(10) Patent No.: US 8,971,746 B2
(45) Date of Patent: Mar. 3, 2015

(54) IMAGE HEATING APPARATUS AND IMAGE FORMING APPARATUS

(71) Applicant: Canon Kabushiki Kaisha, Tokyo (JP)

(72) Inventors: Mitsuru Hasegawa, Tsukubamirai (JP); Kota Arimoto, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/966,620

(22) Filed: Aug. 14, 2013

(65) Prior Publication Data

US 2014/0056606 A1 Feb. 27, 2014

(30) Foreign Application Priority Data

Aug. 22, 2012 (JP) ..... 2012-182939
Jul. 22, 2013 (JP) ..... 2013-152091

(51) Int. Cl.
*G03G 15/20* (2006.01)

(52) U.S. Cl.
CPC ..... *G03G 15/2039* (2013.01); *G03G 15/2042* (2013.01)
USPC ..... 399/67; 399/328

(58) Field of Classification Search
USPC ..... 399/44, 68, 328, 334
See application file for complete search history.

(56) References Cited

U.S. PATENT DOCUMENTS 4,232,959 A * 11/1980 Ateya et al. ..... 399/67
7,113,717 B2 * 9/2006 Bott et al. ..... 399/67
7,536,145 B2 5/2009 Tomine et al.
7,561,818 B2 7/2009 Arimoto et al.
7,684,724 B2 3/2010 Arimoto et al.
7,764,895 B2 7/2010 Tomine et al.
7,949,280 B2 5/2011 Arimoto et al.
8,005,414 B2 8/2011 Hasegawa
8,204,396 B2 * 6/2012 Hamby et al. ..... 399/67
8,254,802 B2 8/2012 Hanashi et al.
8,369,765 B2 2/2013 Arimoto (Continued)

FOREIGN PATENT DOCUMENTS

JP 03192382 A * 8/1991
JP 2000-250374 A 9/2000
JP 2002-174987 A 6/2002
JP 2005-301070 A 10/2005
JP 2010-190967 A 9/2010

*Primary Examiner* — Clayton E LaBalle
*Assistant Examiner* — Leon W Rhodes, Jr.
(74) *Attorney, Agent, or Firm* — Fitzpatrick, Cella, Harper & Scinto

(57) ABSTRACT

A control portion executes a measuring mode and generates a value for adjusting a pressurizing mechanism reflecting a difference of pressurizing conditions of a longitudinal center part and a longitudinal end part of a nip portion. The measuring mode is a mode of detecting temperatures of the nip portion by temperature detecting elements in a process of changing temperature of the nip portion heated by a heater and of generating control information based on detected results. The control information is generated in response to a difference of temperature increase amounts of the temperature detecting elements in a predetermined time in the process of increasing the temperature of the nip portion. The control portion adjusts the pressurizing mechanism based on the control value obtained in the measuring mode after executing a process of heating a recording medium in succession of the process of increasing the temperature of the nip portion.

13 Claims, 10 Drawing Sheets

(56) References Cited

U.S. PATENT DOCUMENTS

| | | | | |
|---|---|---|---|---|
| 8,478,180 | B2 | 7/2013 | Arimoto et al. | |
| 8,626,048 | B2 | 1/2014 | Arimoto | |
| 2008/0080910 | A1 * | 4/2008 | Senda et al. | 399/328 |
| 2012/0263488 | A1 * | 10/2012 | Aslam et al. | 399/68 |
| 2013/0114967 | A1 | 5/2013 | Arimoto et al. | |
| 2013/0299480 | A1 | 11/2013 | Kakubari et al. | |
| 2013/0315639 | A1 | 11/2013 | Arimoto | |
| 2013/0322897 | A1 | 12/2013 | Yago et al. | |

* cited by examiner

IMAGE HEATING APPARATUS AND IMAGE FORMING APPARATUS

BACKGROUND OF THE INVENTION

1. Field of the Invention

The present invention relates to an image heating apparatus and an image forming apparatus configured to heat a recording medium at a nip portion formed between a belt member supported by a supporting structure and a roller member.

2. Description of the Related Art

An image forming apparatus configured to form a toner image on an image carrier, to transfer the toner image directly or through an intermediary of an intermediate transfer body to a recording medium, and to fix the image to the recording medium by heating and pressing the recording medium on which the toner image has been transferred at a nip portion of a fixing apparatus is widely used in general.

Hitherto, a belt heating-type fixing apparatus provided with a nip portion formed by putting a roller member in contact with a belt member supported by a support structure has been put into practical use as disclosed in Japanese Patent Application Laid-open No. 2010-190967 for example. This belt heating-type fixing apparatus is configured such that the nip portion is heated by a heating element assembled in the support structure through the intermediary of the belt member, and such that the temperature of the nip portion is controlled by using a temperature sensor assembled in the support structure.

By the way, there is a case when the pressurizing conditions of a longitudinal center part and of longitudinal end parts of the nip portion change due to time-dependent change and others of a rubber material used for the roller member in the belt heating-type fixing apparatus described above. Then, if a greater amount of pressure is applied eccentrically to the longitudinal end parts of the nip portion due to such changes, the quantity of heat to be applied to an image part that passes through the longitudinal center part of the nip portion may become insufficient, causing uneven fixation. If a greater amount of pressure is applied eccentrically to the longitudinal center part of the nip portion, the conveying speed of the longitudinal center part of the nip portion may increase more than that of the longitudinal end parts, causing wrinkles at a rear end of a recording medium.

In a case of estimating the temperature of longitudinal end part of a nip portion by a temperature sensor disposed at longitudinal end part of a support structure as disclosed in Japanese Patent Application Laid-open No. 2000-250374, a relationship between a detected temperature and an actual temperature of the nip portion varies if pressurizing conditions of the longitudinal center part and of the longitudinal end parts change. As a result, the sensor may overestimate the temperature of the nip portion, decreasing the productivity of the image forming apparatus unnecessarily. Or, the sensor may underestimate the temperature of the nip portion, decreasing the durability of the belt member.

Then, Japanese Patent Application Laid-open No. 2002-174987 has proposed to estimate the pressurizing condition of the entire nip portion by detecting a rotational speed of the roller member forming the nip portion and to change a target temperature of the roller member to be adjusted based on this estimated result.

Japanese Patent Application Laid-open No. 2005-301070 has also proposed to estimate the pressurizing condition of the entire nip portion by measuring an accumulated number of recording media heated at the nip portion or an accumulated used time of the belt member and to change the target temperature of the roller member to be adjusted based on this estimated result.

Unfortunately, the methods disclosed in Japanese Patent Application Laid-open Nos. 2002-174987 and 2005-301070 have had a problem that even though they enable an evaluation of the pressurizing condition of the entire nip portion, they are unable to determine whether the pressure is applied eccentrically on part of the longitudinal center part or the longitudinal end part of the nip portion.

SUMMARY OF THE INVENTION

According to an aspect of the present invention, an image heating apparatus includes an endless belt member that comes in contact with an image surface of a recording medium, a support structure configured to be irrotational, to support an inner side surface of the belt member, and to heat the belt member, a roller member configured to come into contact with the belt member supported by the support structure and to form a nip portion, a pressurizing mechanism configured to form the nip portion by generating a pressurizing force between the support structure and the roller member, a first temperature sensor that detects the temperature of a longitudinal center part of the support structure, a second temperature sensor that detects the temperature of a longitudinal end part of the support structure, and a control portion configured to execute a measuring mode in which the control portion detects the temperatures by the first and second temperature sensors in a process of changing the temperature of the nip portion heated by the support structure, and to generate control information reflecting a difference of pressurizing conditions of the longitudinal end part and the longitudinal center part of the nip portion based the detected results.

Further features of the present invention will become apparent from the following description of exemplary embodiments with reference to the attached drawings.

DESCRIPTION OF THE EMBODIMENTS

First Embodiment

Image Forming Apparatus

Figure 1:
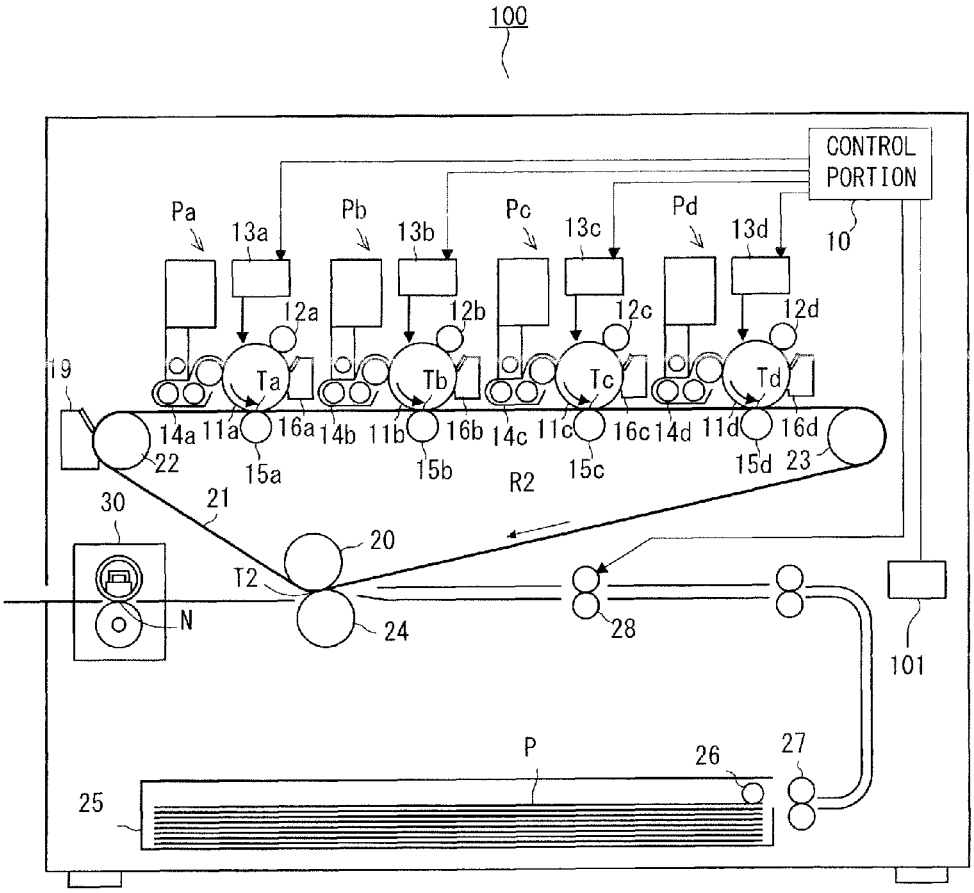
FIG. 1 is a schematic diagram illustrating a configuration of an image forming apparatus.

A first embodiment of the invention will be described below with reference to the drawings. FIG. 1 is a schematic diagram illustrating a configuration of an image forming apparatus 100. As shown in FIG. 1, the image forming apparatus 100 is a tandem-type full-color printer in which image forming portions Pa, Pb, Pc and Pd are disposed along an intermediate transfer belt 21.

A yellow toner image is formed on a photoconductive drum 11*a* in the image forming portion Pa and is then transferred to the intermediate transfer belt 21. A magenta toner image is formed on a photoconductive drum 11*b* in the image forming portion Pb and is then transferred to the intermediate transfer belt 21. In the same manner, cyan and black toner images are formed respectively on photoconductive drums 11*c* and 11*d* in the image forming portions Pc and Pd and are then transferred to the intermediate transfer belt 21.

The four color toner images transferred to the intermediate transfer belt 21 are conveyed to a secondary transfer portion T2 to be transferred to a recording medium P. The recording medium P is taken out of a recording medium cassette 25 by a pickup roller 26. A separation roller 27 separates recording media P one by one by and conveys them to a registration roller 28. The registration roller 28 feeds the recording medium P to the secondary transfer portion T2 in an exact timing with the toner images on the intermediate transfer belt 21.

The recording medium P on which the toner images have been transferred at the secondary transfer portion T2 is separated from the intermediate transfer belt 21 and is then conveyed to a fixing apparatus 30. The fixing apparatus 30 heats and presses the recording medium P to fix the toner images and discharges the recording medium P on which the image is fixed out of the apparatus.

The image forming portions Pa, Pb, Pc and Pd are constructed substantially in the same manner except for the colors of the toners used in developments, i.e., yellow, magenta, cyan, and black. Accordingly, only the image forming portion Pa will be described below and the other image forming portions Pb, Pc and Pd will be described by substituting 'a' with 'b', 'c' and 'd' at the end of the reference characters in the following description.

In the image forming portion Pa, a charging roller 12*a*, an exposure unit 13*a*, a developing unit 14*a*, a primary transfer roller 15*a*, and a cleaning unit 16*a* are disposed around the rotational photoconductive drum 11*a*. The photoconductive drum 11*a* is composed of a metallic cylinder around a surface of which a photoconductive layer is formed, and rotates in a direction of an arrow in FIG. 1 with a predetermined processing speed.

The charging roller 12*a* is configured to charge the surface of the photoconductive drum 11*a* with homogeneous potential. The exposure unit 13*a* is configured to draw an electrostatic latent image on the surface of the photoconductive drum 11*a* by scanning an ON-OFF modulated laser beam of scan line image data laid out from image data by a polygonal mirror. The developing unit 14*a* is configured to supply toner to the photoconductive drum 11*a* to develop the electrostatic image as a toner image.

The primary transfer roller 15*a* forms a primary transfer portion Ta between the photoconductive drum 11*a* and the intermediate transfer belt 21*a*. The toner image is transferred primarily from the photoconductive drum 11*a* to the intermediate transfer belt 21 in response to a DC voltage applied to the primary transfer roller 15*a*. The secondary transfer roller 24 forms the secondary transfer portion T2 with the intermediate transfer belt 21. The toner image is transferred secondarily from the intermediate transfer belt 21 to the recording medium P in response to a DC voltage applied to the secondary transfer roller 24.

[Fixing Apparatus]

Figure 2:
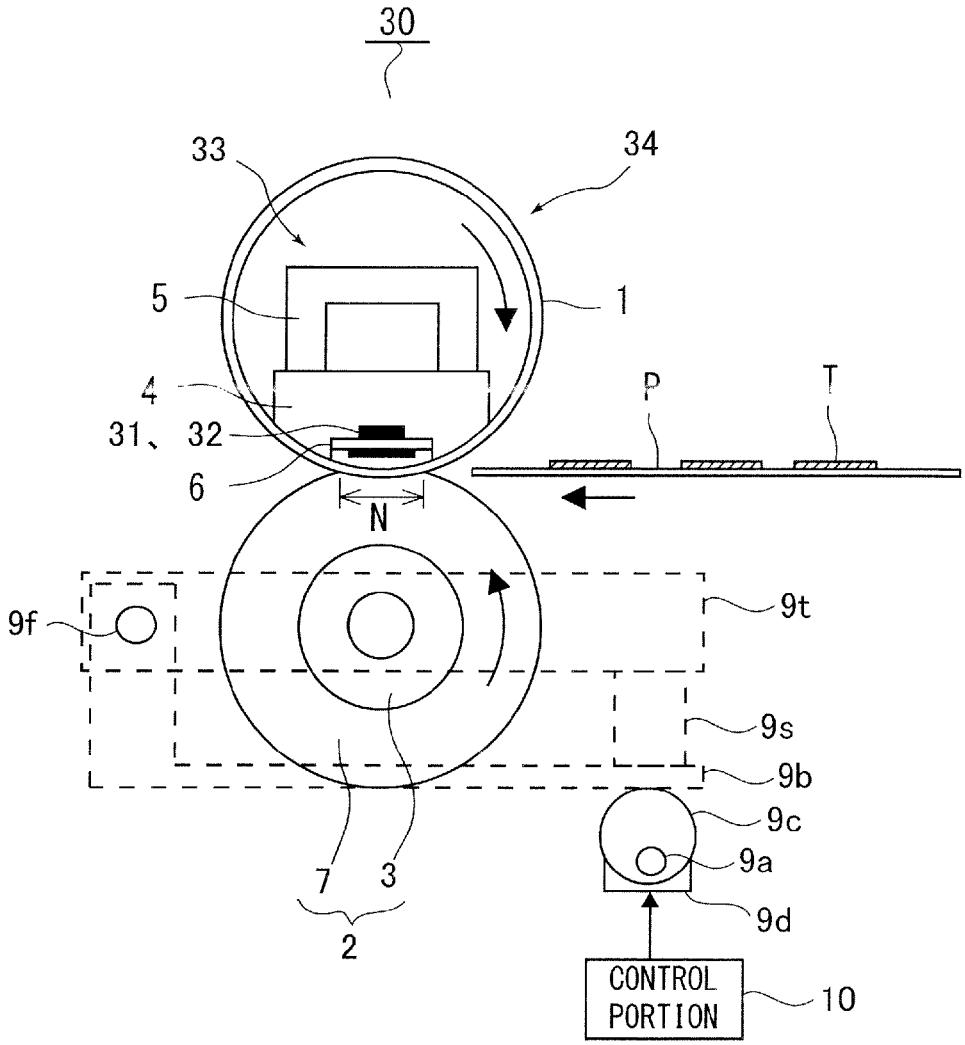
FIG. 2 is a schematic diagram illustrating a configuration of a fixing apparatus.
Figure 3:
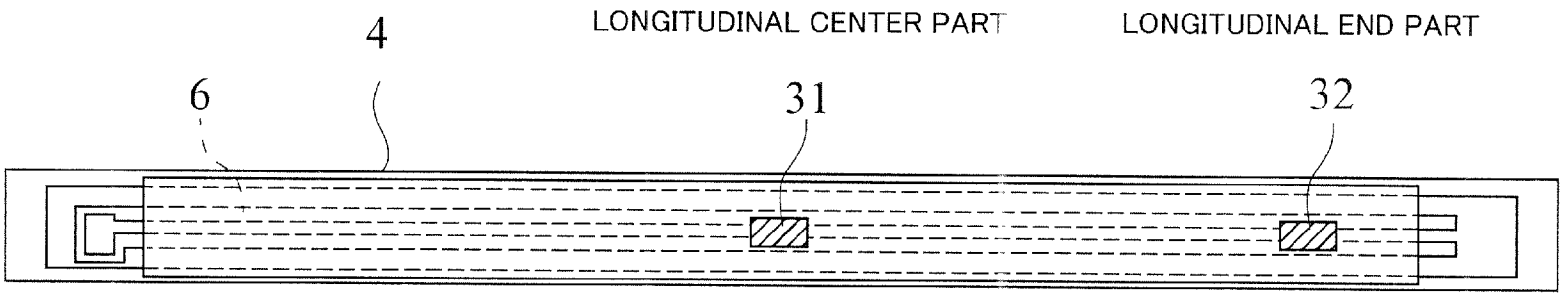
FIG. 3 is a schematic diagram illustrating a configuration of a heater.

Next, a configuration of the fixing apparatus which is one exemplary image heating apparatus will be described. FIG. 2 is a schematic diagram illustrating the configuration of the fixing apparatus 30 and FIG. 3 is a schematic diagram illustrating a configuration of a heater 6. As shown in FIG. 2, because the belt heating-type fixing apparatus 30 is configured such that the heater 6 heats and fixes the toner image on the recording medium P through an intermediary of a thin fixing belt 1, it is possible to increase the temperature and to start up the apparatus in a short time after receiving an image forming job even with less power consumption. The fixing apparatus 30 does not supply power to the heater 6 during a standby time and suppresses power consumption as much as possible.

The fixing belt 1 is rotationally driven with a substantially equal circumferential speed with a conveying speed of the recording medium P carrying the toner image and conveyed from the secondary transfer portion T2 (see FIG. 1). The fixing belt 1 is an endless belt member, which is externally inserted around a guide member 4 and a beam member 5, while having a sufficient margin in terms of its circumferential length. The fixing belt 1 is composed of a high heat conductive and strong metallic layer, an elastic layer such as thermally highly conductive rubber, and a resin layer, which is highly releasable from toner in order to improve the quick-start property of the apparatus by reducing the thermal capacity.

That is, the fixing belt 1 is formed into the endless belt of ϕ25 mm in inner diameter by forming the thermally highly conductive rubber material over the thermally highly conductive metallic layer having high tensile strength and by forming the releasing layer of the fluorine resin on the surface of the elastic layer. The metallic layer is stainless steel of 50 μm thickness, the elastic layer is silicon rubber whose thermal conductivity is 1.0 W/m·K, and the releasing layer is a PFA tube of 30 μm thick. The fixing belt 1 rotates with the predetermined circumferential speed by being driven by rotation of the pressure roller 2 and slides in close contact with a surface of the heater 6.

The guide member 4 slidably rubs an inner side surface of the fixing belt 1 while penetrating through the fixing belt 1 in a longitudinal direction of the fixing belt 1. The guide member 4 is formed into a shape of a beam by using a synthetic resin material, such as liquid crystal polymer, which is heat resistant, which has a high elastic modulus, whose coefficient of friction is low and whose thermal conductivity is also low. The heater 6 is disposed in a recess formed on an under surface of the guide member 4. That is, the guide member 4 is constructed such that the heater 6 is embedded in the recess formed on a side of the pressure roller 2 and a surface thereof is concealed by a glass material.

The beam member 5 longitudinally supports the entire guide member 4 and biases it toward the pressure roller 2. The beam member 5 is formed into a U-shaped beam in section by using a steel member of 10 mm in width, 10 mm in height and 2.3 mm in thickness.

The heater 6 includes an exothermic resistor as a heat source that generates heat in response to supplied electric power, and increases in temperature as the exothermic resistor generates heat. The heater 6, i.e., the exothermic resistor, is formed by thick-film printing and sintering Ag.Pd paste on an $Al_2O_3$ substrate. Temperatures of the guide member 4, the fixing belt 1 and the pressure roller 2 increase as the heater 6 generates heat. The beam member 5, the guide member 4 and the heater 6 compose a support structure 33 that is irrotational, supports the inner side surface of the fixing belt 1, i.e., a belt member, and heats the fixing belt 1. A heating member 34 that heats an image formed on a recording medium is also constructed while including the support structure 33 and the fixing belt 1.

The pressure roller 2 is constructed with an elastic layer 7 made of a soft silicon rubber and formed around an axial member (core metal) 3 formed by a metallic cylindrical material, such as steel and aluminum. The pressure roller 2 is also constructed into a roller having an outer diameter of ϕ25 mm by covering a surface of the elastic layer 7 by a PFA tube as a releasing layer. An aluminum tube having an outer diameter of ϕ10 mm and 3 mm in thickness is used for the shaft member 3. The silicon rubber having 3 mm in thickness and 64° of Asker hardness is used for the elastic layer 7. A thickness of the PFA tube is 50 μm. The pressure roller 2, i.e., a roller member, is in contact with the fixing belt 1 supported by the support structure 33 and forms a nip portion N therewith.

As shown in FIG. 3, two temperature detecting elements 31 and 32 are disposed in contact with a back surface of the heater 6. The temperature detecting element (first temperature sensor) 31 is disposed at a center of conveyance of a sheet to control the temperature of the sheet passing part of the nip portion N. The temperature detecting element 31 located within a sheet passing range of a longitudinally-fed A4 size sheet, which is a smallest size recording medium, is used to control the temperature of the heater 6.

Figure 4:
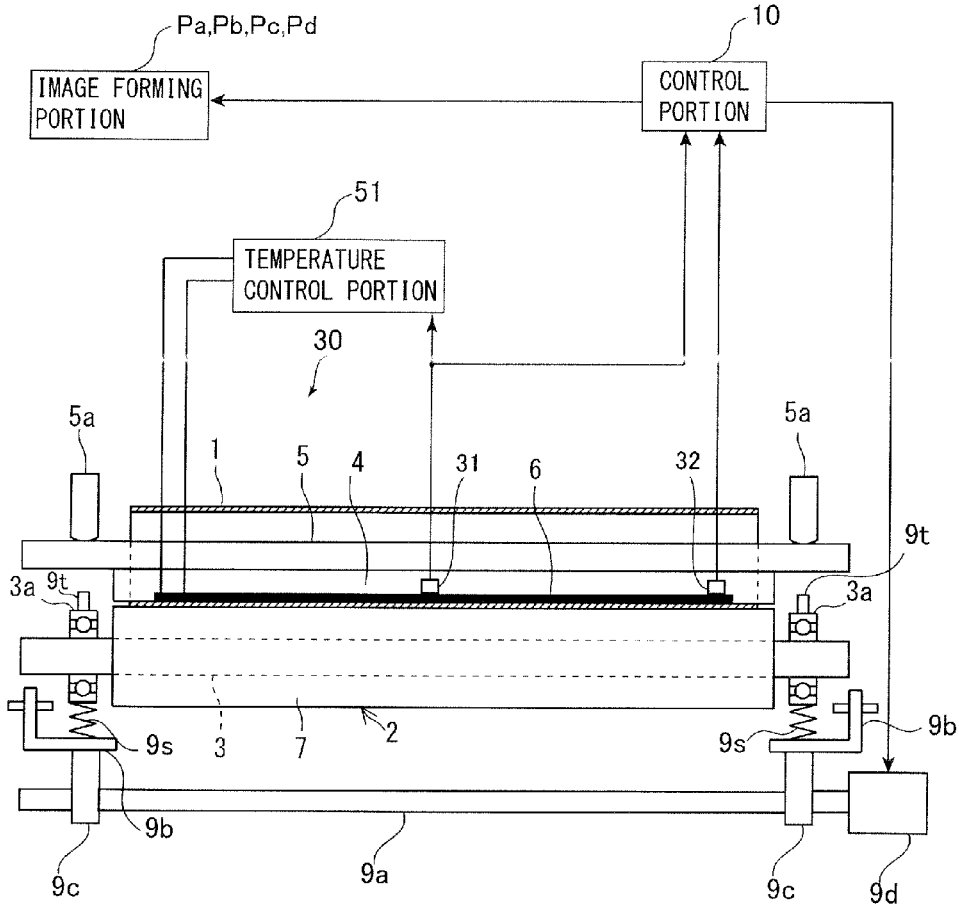
FIG. 4 is a schematic diagram illustrating a configuration of a pressurizing mechanism.

As shown in FIG. 4, a temperature control portion 51 performs PI control (or ON/OFF control) on the supply of power to the heater 6 such that an output of the temperature detecting element 31 approaches a preset value. That is, temperature of the fixing belt 1 is controlled such that the surface temperature thereof is kept within a predetermined temperature range. The temperature control portion 51 adjusts the temperature of the fixing belt 1 until the completion of a series of printing operations in forming images successively. When a final recording medium P of an image forming job passes through the nip portion N and is separated from the fixing belt 1 and is discharged out of the apparatus, the rotational drive of the pressure roller 2 is stopped and the power fed to the heater 6 is also stopped.

Meanwhile, the other temperature detecting element (second temperature sensor) 32 is disposed at a part where no sheet passes (referred to as the 'non-sheet passing part' hereinafter) and is distant from the center of conveyance of sheet by 148 mm. The temperature detecting element 32 located on an outside of the sheet passing range of an A4 elongation size, i.e., a maximum size recording medium, is used to control an increase in temperature of the non-sheet passing part of the fixing belt 1 as described later.

<Pressurizing Mechanism>

Figure 5:
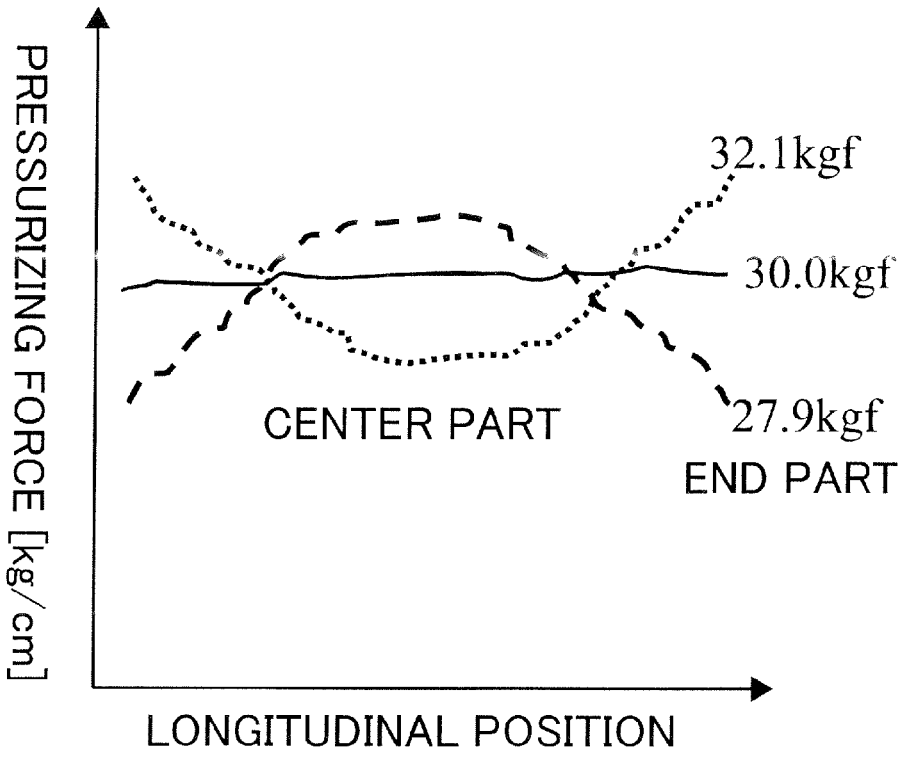
FIG. 5 is a graph explaining a relationship between a pressurizing force of the pressurizing mechanism and a distribution of pressure at a nip portion.

Next, a pressurizing mechanism 9, which is configured to pressurize both end portions of at least one of the support structure 33 and the pressure roller 2 and to adjust a difference of pressurizing conditions of the longitudinal end parts and the longitudinal center part of the nip portion N, will be described. It is noted that FIG. 4 is a schematic diagram illustrating the configuration of the pressurizing mechanism and FIG. 5 is a graph illustrating a relationship between pressurizing forces of the pressurizing mechanism and distributions of pressures at the nip portion. As shown in FIG. 4, a length in the longitudinal direction of the fixing belt 1 is 340 mm, a length in the longitudinal direction of the heater 6 is 370 mm, a length in the longitudinal direction of the guide member 4 is 374 mm, and a length in the longitudinal direction of the pressure roller 2 is 330 mm in the present embodiment. As shown in FIGS. 2 and 4, bearings 3*a* that support both end portions of the pressure roller 2 are fixed to a turning arm 9*t* that pivots centering on a pivot shaft 9*f* with respect to frames 5*a* of the fixing apparatus 30 and is capable of moving the turning ends of the pressure roller 2 up and down. The pressure roller 2, both of whose ends are pressed upward by the pressurizing mechanism 9 described above, comes in pressure contact with the fixing belt 1 whose inner side surface is supported by the guide member 4, deforms the elastic layer 7, and forms the nip portion N that extends in a rotational direction of the belt.

The beam member 5 is supported as a double-supported beam by the frames 5*a* of the fixing apparatus 30, biases the guide member 4 toward the pressure roller 2 through an under surface in the longitudinal direction thereof, and forms the nip portion N between the fixing belt 1 and the pressure roller 2. Both ends of a shaft member 3 of the pressure roller 2 are doubly and rotatably supported by the bearings 3*a*.

The pressurizing mechanism 9 actuates a drive motor 9*d* to rotate a cam shaft 9*a* and a pair of pressurizing cams 9*c* to move a turning end of a turning arm 9*b* up and down. This arrangement moves the pressure roller 2 supported by the bearings 3*a* up and down and changes the pressurizing force against the fixing belt 1. The pressurizing force in pressing the fixing belt 1 is 300 N (30 kgf). When the pressurizing cam 9*c* oscillates the turning arm 9*b*, the turning arm 9*t* pivots centering on the pivot shaft 9*f* through an intermediary of pressure springs 9*s* and moves the bearings 3*a* up and down as shown in FIG. 2.

It is then possible to adjust the distribution of pressures in the longitudinal direction of the nip portion N by controlling the pressurizing mechanism 9. That is, in response to pressurization of the pressurizing mechanism 9, the pressure roller 2 and the beam member 5 deflect under a load such that the longitudinal center parts thereof deflect toward the outside (lower side) as shown in FIG. 4. When the longitudinal center parts of the pressure roller 2 and the beam member 5 deflect toward the outside, the pressurizing force at the longitudinal center part of the nip portion N drops. Then, in order to assure the pressurizing force at the longitudinal center part of the nip portion N by canceling the deflection under load of the pressure roller 2 and the beam member 5, an under surface of the guide member 4 is formed into a shape curved in a direction orthogonal to the rotational direction of the fixing belt 1. The curved portion of the guide member 4 at the longitudinal center part projects by 900 μm toward the nip side as compared to the longitudinal end part. A mutual relationship of nip widths of the longitudinal center part and of the longitudinal end part tends to vary due to the pressurizing force and time-dependent changes of the respective members in such a configuration in which the deflection correcting amount is as large as 900 μm.

When the pressurizing force of the pressurizing mechanism 9 is increased, the distribution of the pressure is lowered at the longitudinal center part of the nip portion N because the longitudinal center parts of the pressure roller 2 and the beam member 5 are deflected toward the outside as shown in FIG. 5. When the pressurizing force of the pressurizing mechanism 9 is reduced, the distribution of pressure increases at the longitudinal center part of the nip portion N because a greater amount of pressure is applied eccentrically to the longitudinal center part of the pressure roller 2 and the beam member 5 by the guide member 4, which is longitudinally curved. The deflection correcting curve is preset when the pressure roller 2 is in a brand-new condition such that the distribution of pressure becomes flat when the pressurizing force is 300 N (30 kgf). When the pressurizing force is increased to be more than 300 N, a pressure per unit length at the longitudinal end part increases as compared to that at the longitudinal center part. When the pressurizing force is lowered to be less than 300 N, the pressure per unit length at the longitudinal center part increases as compared to that at the longitudinal end part. The larger the deflection correcting amount of the curve, the more remarkably this tendency appears.

<Time-dependent Change of Distribution of Pressurizing Force of Nip Portion>

The nip width, i.e., a length of the nip portion N (see FIG. 2) in the rotational direction of the fixing belt 1, varies depending on an accumulated heating time of the pressure roller due to time-dependent change of hardness of the rubber material used as the elastic layer of the pressure roller 2 in the fixing apparatus 30. That is, the greater the accumulated heating time, the greater the decrease in the hardness of the elastic layer of the pressure roller 2 and the more the nip width is widened at the longitudinal center part. If the nip width is widened, the quantity of heat transferring from the fixing belt 1 to the recording medium increases in the process of passing through the nip portion N. As a result, a greater quantity of heat than that initially required to fix a non-fixed image is applied, likely heating the toner image too much at the longitudinal center part of the nip portion N.

While the toner image is likely heated too much at the longitudinal center part of the nip portion N, the nip width is relatively shortened and the fixability drops at the longitudinal end part of each nip portion N. This is likely to cause a drop of quality of a fixed image by generating uneven fixation between the longitudinal center part and the longitudinal end parts of the nip portion. Still further, if the performance for conveying the recording medium varies and becomes defective due to the relative difference of the nip widths at the longitudinal center part and the longitudinal end parts of the nip portion N, wrinkles are prone to be generated at a rear end of the recording medium.

The drop in the hardness of the elastic layer of the pressure roller 2 is also accelerated if the quantity of heat flowing into the elastic layer of the pressure roller 2 increases. A greater quantity of heat than that initially required to fix a non-fixed image is applied in a rear half of the process of the time-dependent change, so that the drop of the hardness of the pressure roller 2 is accelerated further and hot offset of the toner is prone to be generated.

<Configuration of Control Portion>

Figure 6:
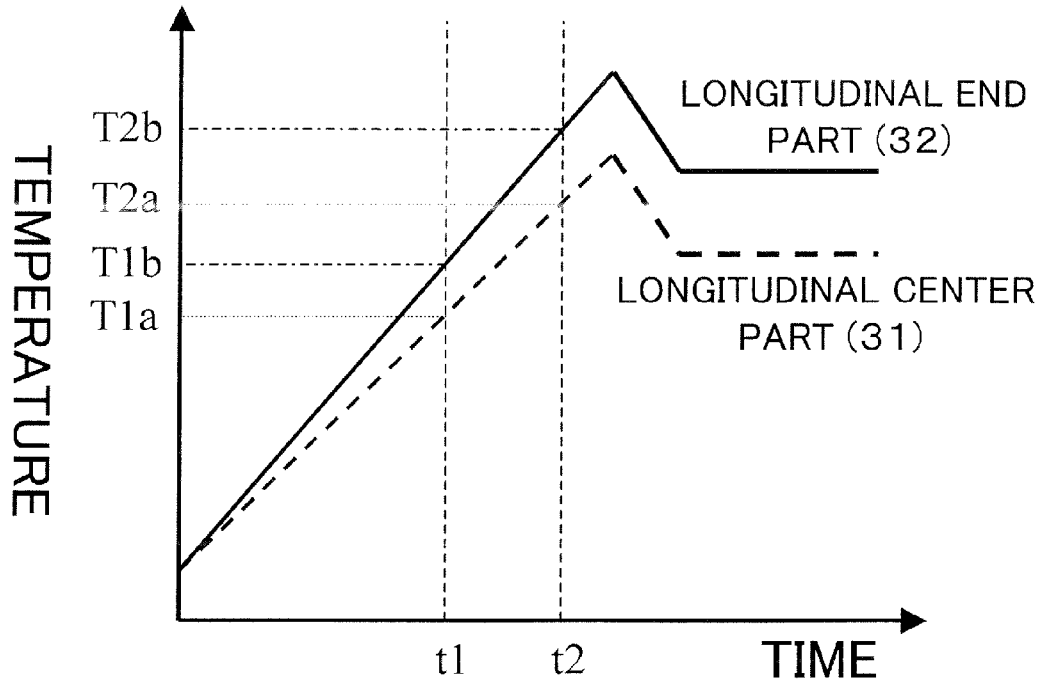
FIG. 6 is a graph illustrating an amount of increase of temperature per temperature detecting element in a heating and temperature increasing process of the fixing apparatus.
Figure 7:
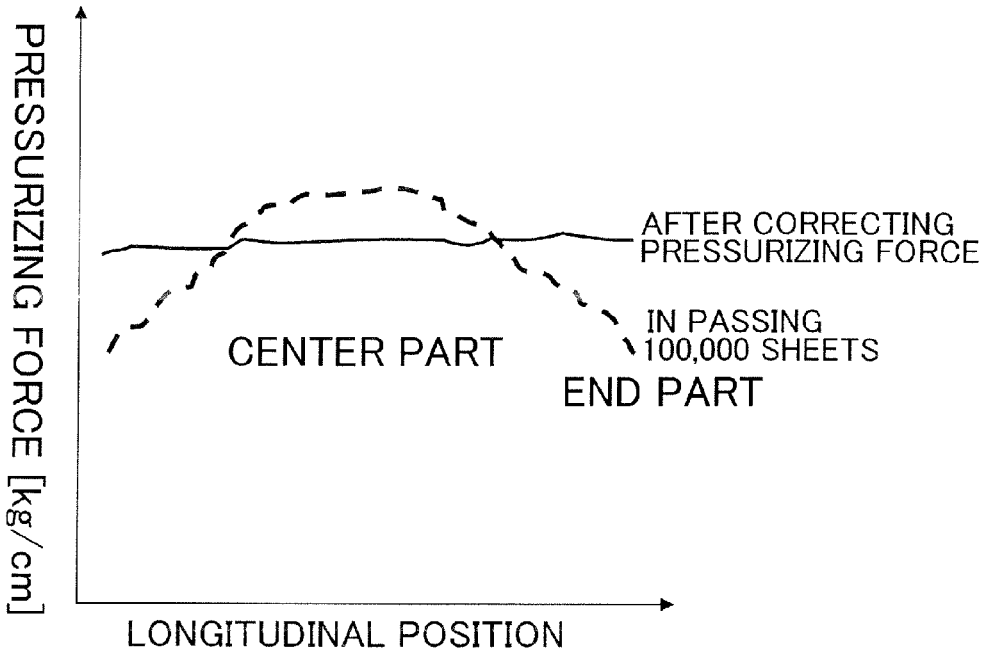
FIG. 7 is a graph illustrating time-dependent changes of a pressure roller and correction of the pressurizing force.
Figure 8:
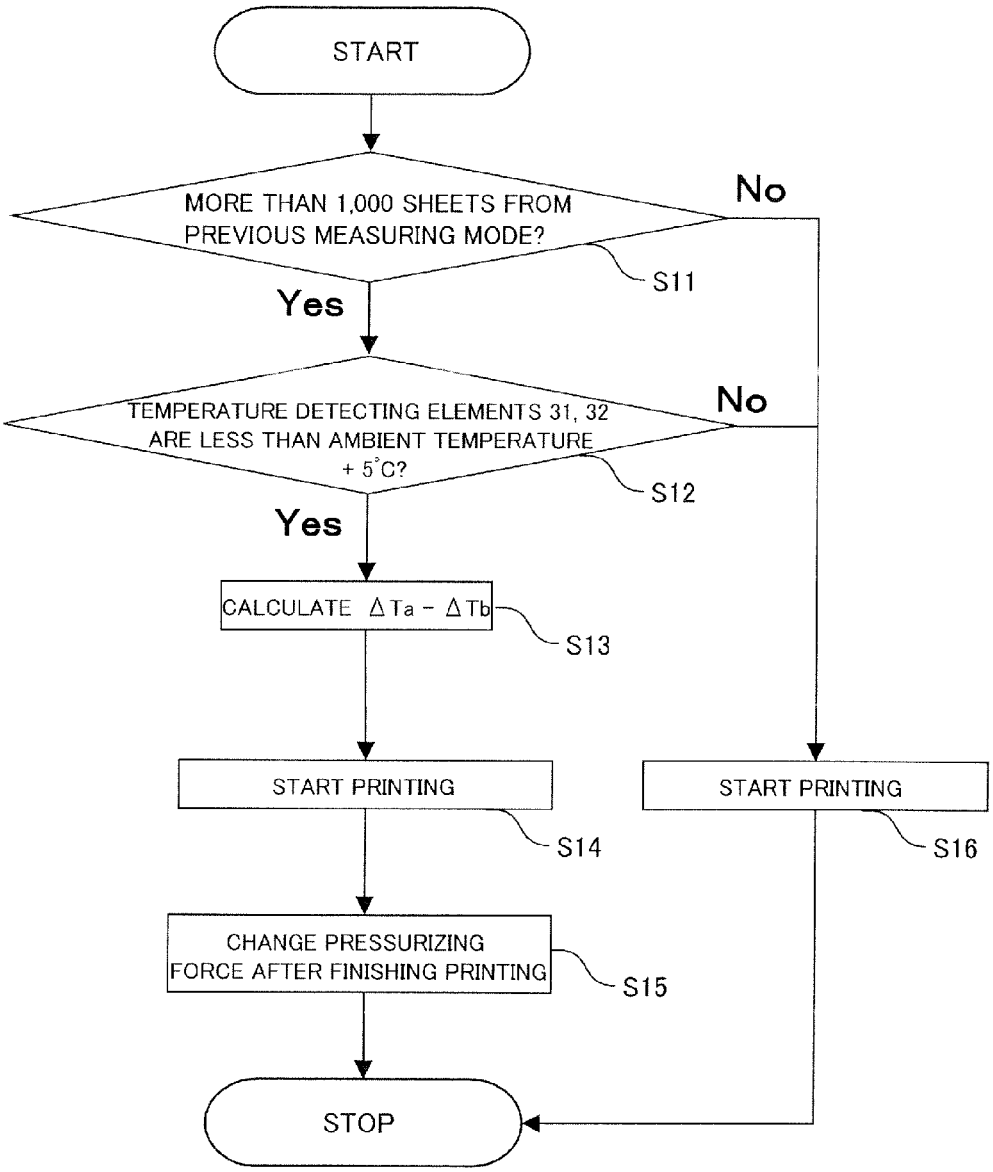
FIG. 8 is a flowchart illustrating a method of controlling a pressurizing force according to a first embodiment.

Then, the pressurizing conditions of the longitudinal center part and the longitudinal end part of the nip portion N of the fixing apparatus 30 are periodically evaluated to recover a predetermined initial condition which enables maintaining of the quality of a fixed image. A control portion 10 (see FIG. 4) that performs the control for recovering the pressurizing condition in the longitudinal direction of the nip portion N will be described below. It is noted that FIG. 6 is a graph explaining the amount of increase of temperature per each temperature detecting element in a heating and temperature increasing process of the fixing apparatus, FIG. 7 is a graph explaining the time-dependent change of the pressure roller and correction of the pressurizing force, and FIG. 8 is a flowchart in controlling the pressurizing force.

The control portion 10, i.e., one exemplary executing portion, executes a measuring mode and generates control information reflecting the difference in the pressurizing conditions of the longitudinal end part and of the longitudinal center part of the nip portion N. The control information is a control value for adjusting the pressurizing mechanism 9 configured to adjust the pressurizing force applied to the both end portions of the pressure roller 2 to adjust the relationship between a temperature increase amount of the temperature detecting element 31 and a temperature increase amount of the temperature detecting element 32 to a predetermined relationship.

The measuring mode is a control mode of detecting the temperatures of the nip portion N by the temperature detecting elements 31 and 32 in the process of changing temperatures of the nip portion N heated by the heater 6 and of generating the control information based on the detected results. More specifically, the control portion 10 executes the measuring mode and generates the control information in response to the difference between the temperature increase amounts of the temperature detecting elements 31 and 32 at a predetermined time in the temperature increasing process of the nip portion N. Then, after executing the process of heating the recording medium at the nip portion N in succession to the process of increasing temperature of the nip portion N, the control portion adjusts the pressurizing mechanism 9 based on the control value obtained in the measuring mode.

As shown in FIG. 3, the temperature detecting elements 31 and 32 are disposed in contact with the heater 6. Here, heat having a calorific value produced by the heater 6 flows out to the pressure roller 2 efficiently at a part of the nip portion N in the longitudinal direction (see FIG. 2) where pressure is high, so that the temperature of the temperature detecting element 31 or 32 drops. The heat having a calorific value produced by the heater 6 flows hardly to the pressure roller 2 at a part of the nip portion N in the longitudinal direction where pressure is low, so that temperature of the temperature detecting element 31 or 32 increases.

As shown in FIG. 6 and with reference to FIG. 4, when there is a difference in the distributions of pressure in the longitudinal direction of the nip portion N, the temperatures of the temperature detecting elements 31 and 32 increase with separate temperature rise curves when the temperature of the nip portion N is increased from a cold state of the fixing apparatus 30 by feeding power to the heater 6. That is, when the pressure roller 2 changes time-dependently and a pressure at the longitudinal center part of the nip portion N is higher than that at the longitudinal end part, the temperature of the temperature detecting element 32 located on the longitudinal end part side becomes higher than that of the temperature detecting element 31 located at the longitudinal center part as shown in FIG. 6. In the measuring mode, the control portion 10 takes in detected temperatures of the temperature detecting elements 31 and 32 at times t1 and t2. It is noted that the time t1 is set to be the time after an elapse of six seconds based on a starting point of feeding power to the fixing apparatus 30, i.e., t1=6 s, and the time t2 is set to be the time after an elapse of eight seconds based on the starting point of feeding power to the fixing apparatus 30, i.e., t2=t8, in the present embodiment.

The temperature detected by the temperature detecting element 31 at the time t1 is represented as T1*a*, and the temperature detected by the temperature detecting element 31 at the time t2 is represented as T2*a*. The temperature detected by the temperature detecting element 32 at the time t1 is represented as T1*b*, and the temperature detected by the temperature detecting element 32 at the time t2 is represented as T2*b*. Then, temperature increase rates (gradients of temperature change) ΔTa and ΔTb detected by the temperature detecting elements 31 and 32 can be expressed as follows:

$$\Delta Ta=(T2a-T1a)$$

$$\Delta Tb=(T2b-T1b)$$

The control portion 10 compares the widths of the increase of temperatures detected by the temperature detecting elements 31 and 32 from the time t1 to the time t2. That is, the control portion 10 compares quantities of transferred heat from the fixing belt 1 to the pressure roller 2 at the location of the temperature detecting elements 31 and 32 by comparing the temperature increase rates ΔTa and ΔTb. The control portion 10 compares the quantities of transferred heat per unit length of the nip portion N at the temperature detecting elements 31 and to evaluate the nip widths at the locations of the temperature detecting elements 31 and 32. Then, the control portion 10 evaluates not only the size of the nip widths, but also the heat transferring performance of the nip portion N including the magnitude of heat resistance existing between the heater 6 and the fixing belt 1 and the magnitude of the heat resistance existing between the fixing belt 1 and the pressure roller 2. That is, the control portion 10 is configured to detect temperatures of the nip portion N by the temperature detecting elements 31 and 32 in a process of changing the temperature of the nip portion N heated by the heater 6, to determine whether the a distribution of pressurizing force of the longitudinal center part of the nip portion N is larger than that of the longitudinal end part in response to the gradient of temperature change of the temperature detecting element 31 being larger than the gradient of temperature change of the temperature detecting element 32, and to determine whether the distribution of pressurizing force of the longitudinal center part of the nip portion N is smaller than that of the longitudinal end part in response to the gradient of temperature change of the temperature detecting element 31 being smaller than the gradient of temperature change of the temperature detecting element 32.

The control portion 10 detects the heat transferring conditions of the nip portion in response to the difference of the temperature increase rates ΔTa and ΔTb, and realizes a distribution of pressurizing force and a distribution of temperature homogeneous in the longitudinal direction by optimally correcting the pressurizing force in response to the heat transferring condition of the nip portion as shown in Table 1:

TABLE 1

| ΔTa − ΔTb(° C.) | ~−10 | −9~−4 | −3~3 | 4~9 | 10~ |
|---|---|---|---|---|---|
| Pressurizing force (N) | 321 | 315 | 300 | 285 | 279 |

When ΔTa<ΔTb as shown in Table 1, i.e., when the quantity of transferred heat is large at the longitudinal center part of the nip portion N as compared to that at the longitudinal end part, the control portion 10 corrects the pressurizing force such that the pressurizing force of the pressurizing mechanism 9 is increased to increase the nip width of the longitudinal end part. When ΔTb<ΔTa in contrast, i.e., when the quantity of transferred heat is large at the longitudinal end part of the nip portion N as compared to that at the longitudinal center part, the control portion 10 corrects the pressurizing force such that the pressurizing force of the pressurizing mechanism 9 is reduced to increase the nip width of the longitudinal center part.

The distribution of pressure in the longitudinal direction of the nip portion N initially preset to be flat is changed to a distribution of pressure in which the pressure is low in both longitudinal end parts after feeding 100,000 sheets as shown in FIG. 7. That is, the hardness and the outer diameter of the rubber material of the pressure roller 2 change and the pressures at the longitudinal end parts drop along with the accumulation of the number of heated recording media. In this case, the control portion 10 corrects the pressurizing force by increasing the pressurizing force of the pressurizing mechanism 9 from 300 N (30 kgf) to 315 N (31.5 kgf) to recover the distribution of pressurizing force equal to that in the initial condition of the fixing apparatus 30.

As shown in FIG. 8 and with reference to FIG. 4, the control portion 10 counts the accumulated number of printed sheets from the previously executed measuring mode of the pressurizing mechanism 9 in Step S11. When the accumulated number of printed sheets is less than 1,000 sheets, i.e., No in Step S11, the control portion 10 executes a normal printing operation in Step S16 and finishes an image forming job.

When the accumulated number of printed sheets exceeds 1,000 sheets, i.e., Yes in Step S11, the control portion 10 executes the measuring mode in Steps S12 and S13. In executing the measuring mode, first, the control portion 10 obtains detected temperatures of the temperature detecting elements 31 and 32 and compares them with an ambient temperature in Step S12. When either detected temperature is lower than the ambient temperature+5°, the control portion 10 calculates the temperature increase rates ΔTa and ΔTb in Step S13.

When either one detected temperature is higher than the ambient temperature+5°, i.e., No in Step S12, the control portion 10 executes the normal printing operation in Step S16 and finishes the job without executing the measuring mode. That is, a condition of starting the measuring mode is set such that the temperatures of the temperature detecting elements 31 and 32 are lower than the ambient temperature+5°. This is because it is unable to detect the quantity of transferred heat by the temperature increasing rate accurately if the accumulated heat caused by the previous printing job remains. It is noted that the ambient temperature is detected by a temperature sensor 101 (see FIG. 1) provided in the image forming apparatus 100, and is transmitted to the control portion 10.

The control portion 10 calculates ΔTa−ΔTb to obtain the difference between the temperature increase rates ΔTa and ΔTb in Step S13. Then, the control portion 10 obtains the pressurizing force corresponding to the calculation result of ΔTa−ΔTb from Table 1 and finishes the measuring mode.

When the detected temperature of the temperature detecting element 31 reaches the predetermined target temperature, the control portion 10 executes printing of the image forming job in Step S14. In order not to generate downtime of the image forming apparatus 100, the control portion 10 does not execute the adjustment of the pressurizing force of the nip portion N using the pressurizing mechanism 9 at this point of time.

After finishing printing of the image forming job, the control portion 10 rotates the pressurizing cam 9*c* to an angular position corresponding to the pressurizing force obtained in the measuring mode and executes the adjustment of the pressurizing force of the nip portion N using the pressurizing mechanism 9 in Step S15.

As described above, the control portion 10 executes the measuring mode periodically in starting the fixing apparatus and adjusts the pressurizing force of the pressurizing mechanism 9 in accordance to the result measured in the measuring mode in the present embodiment. The control portion 10 measures the flow of heat in the longitudinal center part and in the longitudinal end part of the nip portion N in the measuring mode, and changes the pressurizing force of the pressurizing mechanism 9 in response to the measured results.

Thus, the present embodiment makes it possible to obtain a flat temperature distribution in the longitudinal direction by adjusting the distribution of pressure to be flat in the longitudinal direction of the nip portion N that otherwise varies depending on variation of parts and the accumulated used period of the fixing apparatus 30, so that it is possible to improve the quality of a fixed image. That is, the fixing apparatus 30 of the present embodiment can realize the improvement of the quality of the fixed image by recovering the temperature distribution in the longitudinal direction of the nip portion N to be the initial optimal temperature distribution.

The present embodiment also makes it possible to cancel the variations of the parts and of the pressurizing forces and to adjust the pressurizing condition of the nip portion to be constant at an end of assembly of the apparatus by executing the measuring mode even when inexpensive and less rigid parts are used to form the nip portion. Therefore, the present embodiment permits the realization of a low-cost and downsized fixing apparatus 30 and makes it unnecessary to differentiate optimal values of control parameters, such as setting of the temperature per fixing apparatus 30. The present embodiment also makes it possible to eliminate the relative difference of the nip widths of the longitudinal center part and the longitudinal end parts per fixing apparatus 30 otherwise caused by the variations of the parts and of the distribution of pressurizing forces, and to avoid degradations of an image and of conveyance of a recording medium, and a variation of an excessive increase of temperature of the non-sheet passing parts.

The present embodiment also makes it possible to evaluate the distribution of pressures in the longitudinal direction of the nip portion N with high precision by using the existing temperature detecting element 31 used in controlling the temperature of the fixing apparatus 30 and the existing temperature detecting element 32 used in controlling the productivity of the fixing apparatus 30.

The present embodiment also makes it possible to evaluate the distribution of pressures in the longitudinal direction of the nip portion readily and without any downtime as compared to a case of directly evaluating conditions of the nip widths of the center and end parts of the nip portion N by performing a measurement of the nip widths by means of a nip sheet or a measurement of a shape of a nip by an optical sensor or the like.

Still further, the present embodiment makes it possible to detect the shape of the nip (flow of heat) at the longitudinal center part and the longitudinal end parts of the fixing apparatus and to change the pressurizing force in accordance to the detected result. Thus, it is possible to obtain the optimal temperature distribution in the longitudinal direction in response to the condition of the nip that varies depending on the variation of the members and a period of service of the fixing apparatus.

It is noted that the distribution of pressures in the longitudinal direction of the nip portion N has been estimated by using the difference of the temperature increase rates of a certain period of time at the longitudinal center part and the longitudinal end part of the nip portion N in the explanation described above. However, it is also possible to estimate the distribution of pressures in the same manner by using a difference of periods of times respectively required to obtain a certain temperature increase width at the longitudinal center part and the longitudinal end part of the nip portion N.

Still further, although the timing for executing the measuring mode has been the heating and temperature increasing process in starting the fixing apparatus 30 first after printing 1,000 sheets in the explanation described above, it is possible to execute the measuring mode at any number of printed sheets or at any accumulated operation time. The measuring mode may be executed not only in starting the fixing apparatus by receiving an image forming job, but also in starting the image forming apparatus 100 by supplying power initially in a day. It is also possible to provide a dedicated measuring mode sequence started from a manipulation panel not shown as a service mode. The timing for changing the pressurizing force after the measuring mode may be also arbitrarily set. The numerical values used in the present embodiment are optimized by experiments, and vary depending on a configuration of the fixing apparatus 30, and are not determined uniquely.

Second Embodiment

Next, a second embodiment of the invention will be described below. The second embodiment is different from the first embodiment in that the distribution of pressurizing force of the nip portion is corrected by noticing on an increase of temperature of the non-sheet passing part. Accordingly, an explanation of the similar configurations with those of the first embodiment will be omitted and only points different from the first embodiment will be explained in the following description.

In the second embodiment, the measuring mode and the correction of the pressurizing force are executed in installing the image forming apparatus or in replacing a structural member of the fixing apparatus 30 such as the pressure roller 2. In installing the image forming apparatus 100 or in replacing the member of the fixing apparatus 30, a service man manipulates an unillustrated manipulation panel to execute the measuring mode. Then, the control portion 10 executes a measuring mode and evaluates the size relationship between the pressurizing force of the longitudinal center part and the pressurizing force of the longitudinal end part of the nip portion. Then, the control portion 10 adjusts and equalizes the pressurizing force of the longitudinal center part with the pressurizing force of the longitudinal end part of the nip portion by reflecting such equalization in a control value obtained in the measuring mode immediately to the pressurizing mechanism 9.

<Control of Increase of Temperature of Non-Sheet Passing Part>

Figure 9:
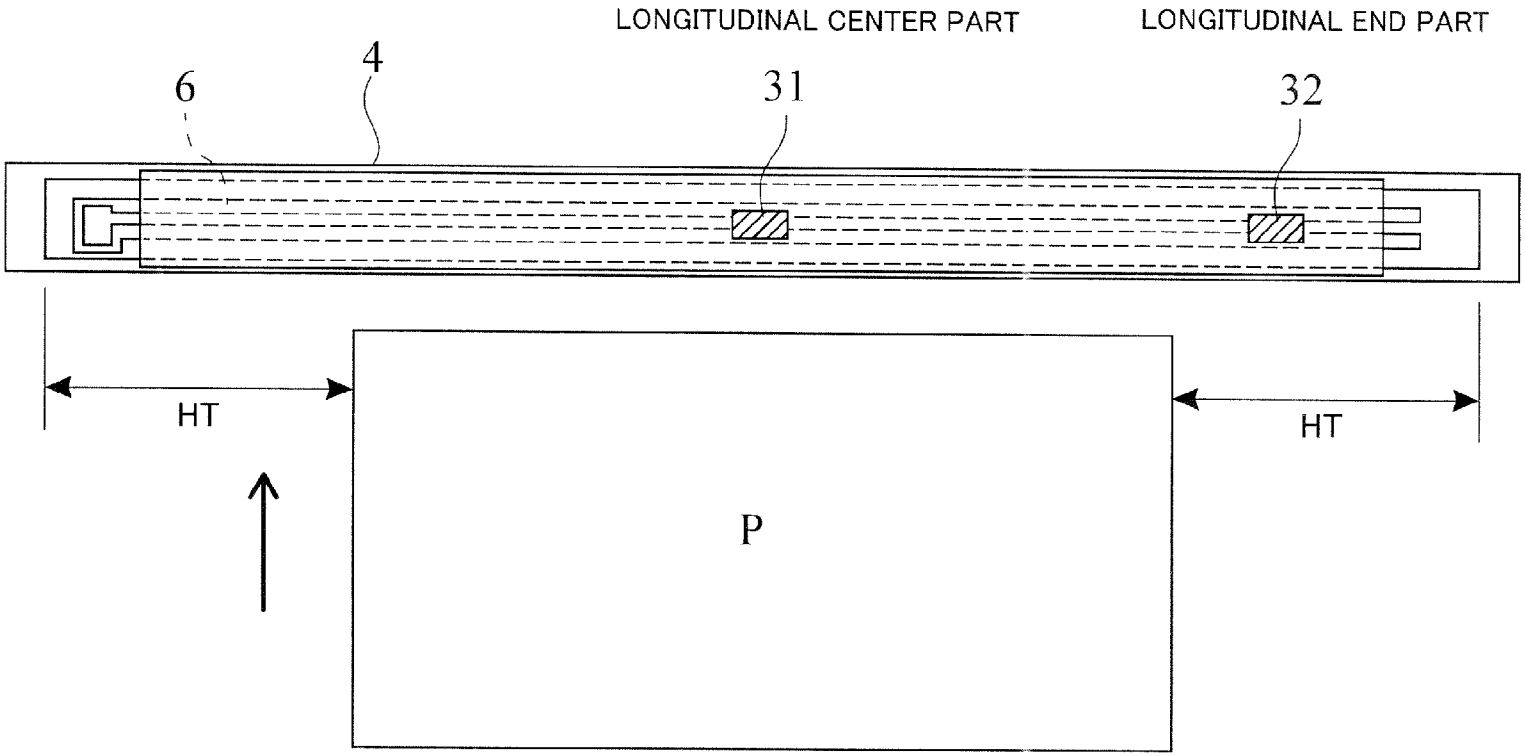
FIG. 9 is a schematic diagram illustrating an increase of the temperature of a non-sheet passing part.

FIG. 9 is a schematic diagram illustrating an increase of temperature of the non-sheet passing part. As shown in FIG. 9, a quantity of heat taken away by a recording medium is largely different at the sheet passing part through which the recording medium passes and the non-sheet passing part through which the recording medium does not pass in printing on a recording medium (small size sheet) whose width is smaller than a maximum heating width in the longitudinal direction of the nip portion N (see FIG. 4) in the fixing apparatus 30. Therefore, if the calorific value of the heat produced by the heater 6 is controlled such that a detected temperature of the temperature detecting element 31 disposed at the sheet passing part maintains a predetermined target temperature, the temperature of the non-sheet passing part HT from which no heat is taken away by the recording medium gradually increases, thus causing an increase of temperature of the non-sheet passing part HT.

If the temperature of the non-sheet passing part HT of the fixing belt 1 increases such that it exceeds a designed temperature, the durability of the fixing belt 1 is shortened. Still further, hot offset in which toners move from a recording medium to the fixing belt 1 is prone to be generated because the temperature becomes too high when a recording medium whose width is wider than that of the previous one is heated under the condition in which the temperature of the non-sheet passing part is increased and the temperature of the fixing belt 1 is partially high.

Then, the fixing apparatus 30 is configured to prolong intervals of the recording media P fed to the nip portion N when the temperature detected by the temperature detecting element 32 disposed at the non-sheet passing part HT reaches a predetermined upper limit temperature. That is, the fixing apparatus 30 is arranged such that the temperature of the non-sheet passing part HT does not increase further by reducing the number of heat-processed sheets (throughput) per unit time of the fixing apparatus 30.

The temperature detecting element 32 is disposed at the location distant by 148 mm from the center of conveyance of sheet, and is used to control the throughput of the fixing apparatus 30. When the temperature detected by the temperature detecting element 32 reaches a threshold temperature Tp of the increase of temperature of the non-sheet passing part, the control portion 10 drops the throughput. The threshold temperature Tp is preset based on an aspect of heat resistance and others of the fixing belt 1. When the throughput drops, the average quantity of heat applied from the heater 6 to the non-sheet passing part is reduced and the increase of temperature of the non-sheet passing part is suppressed because the time during which the recording media P do not pass the nip portion N increases.

The length of the non-sheet passing part HT varies, corresponding to the width of a recording medium passing through the fixing apparatus 30, varying also a condition of the temperature increase curve of the non-sheet passing part and the position of a peak of the increase of temperature of the non-sheet passing part. Due to that, the threshold temperatures Tp, different in response to different widths of recording media, are preset as shown Table 2. Each numerical value in Table 2 represents the relationship between the width of the recording medium and the threshold temperature Tp obtained from experiments. The threshold temperatures Tp in Table 2 vary, depending on the types of the fixing apparatus, such as heat resistance of the fixing belt 1 and are not determined uniquely.

TABLE 2

| | SHEET WIDTH (mm) | | | | |
|---|---|---|---|---|---|
| | 290.0~ 300.0 | 268.0~ 289.9 | 234.0~ 267.9 | 210.0~ 233.9 | ~209.9 |
| Threshold Temperature (° C.) | 240 | 260 | 250 | 240 | 230 |

The control portion 10 changes the throughput so that the temperature detected by the temperature detecting element 32 disposed at the area where recording media do not pass (non-sheet passing part area of the nip portion N) exceeds the preset threshold temperature. When the temperature of the non-sheet passing part increases and the temperature detected by the temperature detecting element 32 reaches the threshold temperature Tp in Table 2, the control portion 10 drops the level of the throughput specified in Table 3 by one level. Table 3 shows the relationship between the throughput level and the productivity represented by a number of processed sheets per minute (ppm). The respective numerical values of the productivity in Table 3 also vary depending on the types of the image forming apparatus and are not determined uniquely.

TABLE 3

| Throughput Lv | Lv1 | Lv2 | Lv3 | Lv4 | Lv5 |
|---|---|---|---|---|---|
| Productivity (sheet/min) | 30 | 20 | 15 | 10 | 5 |

An image forming process is started with a productivity of 30 ppm by setting the throughput level at Lv1 as shown in Table 3. When the temperature detected by the temperature detecting element 32 reaches the threshold temperature Tp in the process of forming images successively, the control portion 10 drops the throughput level from Lv1 to Lv2 and continues the image forming process with a productivity of 20 ppm. The control portion 10 controls the apparatus in the same manner also after that and drops the throughput level to Lv3 and Lv4 every time the temperature reaches the threshold temperature Tp.

By the way, the threshold temperature Tp shown in Table 2 is predetermined mainly by heat resistant temperature of the fixing belt 1. However, it is unable to directly detect the temperature of the fixing belt 1 and the pressure roller 2, even though the temperature of the guide member 4 and the temperature detecting element 32 themselves can be directly detected, because the temperature detecting element 32 is disposed on the back surface of the heater 6 in the fixing apparatus 30. Therefore, the threshold temperature has been set based on a predictive value of belt surface temperature obtained by experiments and other performance data from the past. However, the difference between the predictive value and the actual temperature increases when the shape of the nip portion of the non-sheet passing part, i.e., the quantity of transferred heat, changes due to variations of parts and sizes, due to time-dependent change, and other factors. Specifically, the quantities of heat transferring between the heater 6 and the fixing belt 1 and between the fixing belt 1 and the pressure roller 2 vary. When the nip width of the non-sheet passing part area is narrow for example, the temperature of the heater 6 increases relatively because the quantity of heat transferred to the pressure roller 2 decreases. When the nip width of the non-sheet passing part area is wide in contrast, the temperature of the heater 6 drops relatively because the quantity of heat transferred to the pressure roller 2 increases.

Table 4 shows the relationship between the temperature of the temperature detecting element 32 and surface temperature of the fixing belt 1 when the pressurizing force is changed. The respective numerical values represent temperatures when the increase of temperature of the non-sheet passing part is saturated after feeding a large amount of small size sheets:

TABLE 4

| Pressurizing force (N) | 321 | 315 | 300 | 285 | 279 |
|---|---|---|---|---|---|
| Detected Temperature (° C.) | 247 | 255 | 260 | 265 | 273 |
| Belt Surface Temperature | 218 | 213 | 210 | 207 | 202 |

When the relationship of the magnitude of the pressurizing forces of the longitudinal center part and longitudinal end part is changed by changing the pressurizing force of the pressurizing mechanism 9, the relationship between the temperature detected by the temperature detecting element 32 and the surface temperature of the fixing belt 1 changes as shown in Table 4. That is, when the pressurizing force is increased, a gap between the temperature detected by the temperature detecting element 32 and the surface temperature of the fixing belt 1 decreases, and when the pressurizing force is reduced, the gap between the temperature detected by the temperature detecting element 32 and the surface temperature of the fixing belt 1 increases.

Therefore, when the pressure is applied eccentrically to the longitudinal center part after feeding 100,000 sheets as shown in FIG. 7, the pressurizing force at the longitudinal end part drops, and the gap between the detected temperature of the temperature detecting element 32 and the surface temperature of the fixing belt 1 increases. As a result, the detected temperature of the temperature detecting element 32 reaches the threshold temperature under a condition in which the surface temperature of the fixing belt 1 is considerably lower than the designed temperature. This condition lowers the throughput level unnecessarily and lowers the productivity of the image forming apparatus 100 considerably.

When the pressurizing force at the longitudinal end part of the nip portion N is increased contrary as described in the first embodiment, the gap between the detected temperature of the temperature detecting element 32 and the surface temperature of the fixing belt 1 decreases instantly. As a result, there may be a case when the actual surface temperature of the fixing belt 1 might have already exceeded the designed temperature at a moment of time when the detected temperature of the temperature detecting element 32 reaches the threshold temperature.

Therefore, according to the second embodiment, the fixing apparatus 30 is arranged to evaluate the pressurizing conditions of the longitudinal center part and the longitudinal end part of the nip portion N periodically in the same manner with the first embodiment and to recover the relationship between the detected temperature of the temperature detecting element 32 and the surface temperature of the fixing belt 1 to the predetermined initial condition.

Third Embodiment

Figure 10:
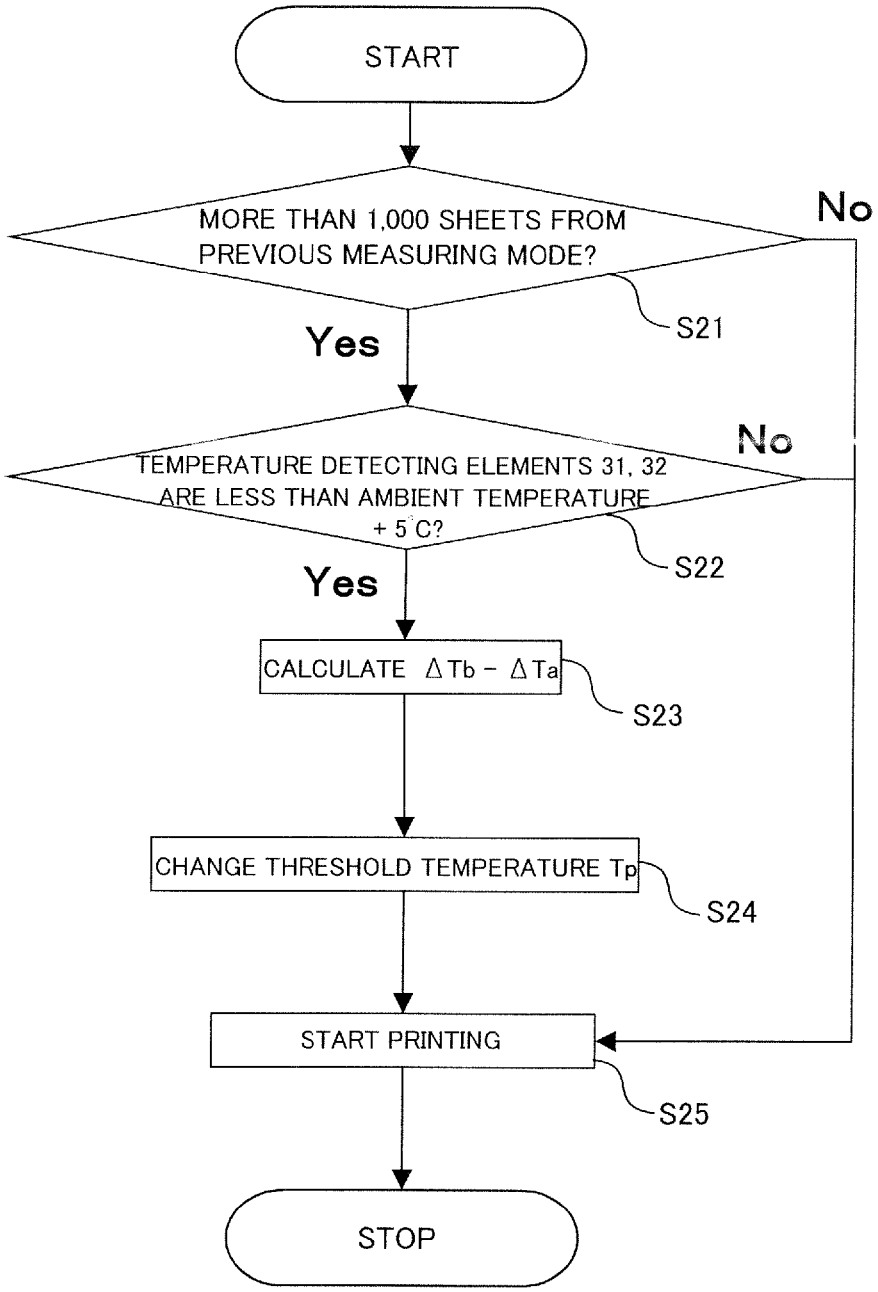
FIG. 10 is a flowchart illustrating a method of controlling the increase of the temperature of a non-sheet passing part according to a second embodiment.

Next, a third embodiment of the invention will be described below. The third embodiment is different from the first and second embodiments in that the threshold temperature of the temperature detecting element is corrected in response to the distribution of pressurizing force in the longitudinal direction of the nip portion. Accordingly, an explanation of the similar configurations to those of the first and second embodiments will be omitted and only points different from the first and second embodiments will be explained in the following description. It is noted that FIG. 10 is a flowchart of a control process of increasing the temperature of the non-sheet passing part of the third embodiment.

As shown in FIG. 4, when the detected temperature of the temperature detecting element 32 reaches the threshold temperature, the control portion 10 controls the image forming portions Pa, Pb, Pc and Pd to extend image intervals. The image forming portions Pa, Pb, Pc and Pd and the secondary transfer portion T2 form and transfer toner images to recording media with variable image intervals. That is, the control portion 10 drops the number of sheets to be processed per unit time in a heating process stepwise every time the detected temperature of the temperature detecting element 32 reaches the threshold temperature in executing the process of heating the recording medium P in the nip portion N in succession to the process of increasing temperature of the nip portion N.

Control information in the third embodiment is the threshold temperature of the detected temperature of the temperature detecting element 32 that restricts the increase of temperature of the longitudinal end part of the nip portion N. The control portion 10 increases the threshold temperature stepwise in response to an increase in a plus direction of the value of a difference obtained by subtracting the temperature increase amount of the temperature detecting element 31 from the temperature increase amount of the temperature detecting element 32 within a predetermined time.

As shown in FIG. 1, the control portion 10 also controls the exposure units 13*a*, 13*b*, 13*c* and 13*d* to change the intervals of the toner images formed on the intermediate transfer belt 21. The registration roller 28 feeds recording media to the secondary transfer portion T2 such that a front edge of the recording medium is aligned with a front edge of the toner image on the intermediate transfer belt 21. The secondary transfer portion T2 feeds the recording media P to the fixing apparatus 30 at intervals corresponding to the intervals of the toner images on the intermediate transfer belt 21.

The control portion 10 also controls the exposure units 13*a*, 13*b*, 13*c* and 13*d* in response to the detected temperature of the temperature detecting element 32 and to the predetermined threshold temperature to change the intervals of the recording media fed from the secondary transfer portion T2 to the nip portion N.

The control portion 10 executes the measuring mode in the process of heating and increasing temperature of the fixing apparatus 30 to correct the threshold temperature. The control portion 10 corrects the threshold temperature in response to detected temperatures of two or more temperature detecting elements in the measuring mode. The threshold temperatures are variably set as shown in Table 5 in accordance to the detected results in the measuring mode:

TABLE 5

| | | SHEET WIDTH (mm) | | | | |
|---|---|---|---|---|---|---|
| | | 290.0~300.0 | 268.0~289.9 | 234.0~267.9 | 210.0~233.9 | ~209.9 |
| ΔTb − ΔTa(° C.) | ~−10 | 235 | 255 | 245 | 235 | 225 |
| | −9~−4 | 238 | 258 | 248 | 238 | 228 |
| | −3~3 | 240 | 260 | 250 | 240 | 230 |
| | 4~9 | 242 | 262 | 252 | 242 | 232 |
| | 10~ | 245 | 265 | 255 | 245 | 235 |

As shown in Table 5, corrected threshold temperatures Tp are set in response to differences between the temperature increase rates ΔTa and ΔTb (ΔTb−ΔTa) calculated in the same manner with the first embodiment in the measuring mode. The numerical values in Table 5 are what detected temperatures of the temperature detecting element 32 are experimentally obtained when the surface temperature of the fixing belt 1 (or the surface temperature of the pressure roller 2) coincides with the designed temperature. The temperature increase rates ΔTa and ΔTb in Table 5 can be obtained in the same manner as described in the first embodiment with reference to FIG. 6.

As shown in FIG. 10 and with reference to FIG. 4, the control portion 10 counts the number of accumulated printed sheets from the previously executed measuring mode of the pressurizing mechanism 9 in Step S21. When the accumulated number of printed sheets is less than 1,000 sheets, i.e., No in Step S21, the control portion 10 executes a normal printing operation in Step S25 and finishes an image forming job.

The control portion 10 performs the measuring mode periodically in response to the total number of printed sheets of the image forming apparatus 100, i.e., every time when 1,000 sheets are printed, to correct the threshold temperature. When the accumulated number of printed sheets exceeds 1,000 sheets, i.e., Yes in Step S21, the control portion 10 executes the measuring mode in Steps S22 and S23.

In executing the measuring mode, the control portion 10 obtains detected temperatures of the temperature detecting elements 31 and 32 and compares them with an ambient temperature in Step S22. When either detected temperature is lower than the ambient temperature+5°, the control portion 10 calculates the temperature increase rates ΔTa and ΔTb in Step S23.

When either one detected temperature is higher than the ambient temperature+5°, i.e., No in Step S22, the control portion 10 executes the normal printing operation in Step S25 and finishes the job without executing the measuring mode. That is, a condition of starting the measuring mode is set such that the temperatures of the temperature detecting elements 31 and 32 are lower than the ambient temperature+5°. It is because it is unable to detect the quantity of transferred heat by the temperature increasing rate accurately if accumulated temperature caused by the previous printing job is left.

The control portion 10 calculates ΔTb−ΔTa to obtain the difference between the temperature increase rates ΔTa and ΔTb in Step S23. Then, the control portion 10 obtains the threshold temperature Tp in response to the calculation result of ΔTb−ΔTa from Table 5, changes the threshold temperature Tp in Step S24, and finishes the measuring mode.

When the detected temperature of the temperature detecting element 31 reaches the predetermined target temperature, the control portion 10 executes printing of the image forming job in Step S25.

When the detected temperature of the temperature detecting element 32 increases and reaches the threshold temperature Tp while executing the image forming job, the control portion 10 decreases the throughput level by one level as shown in Table 3. The control portion 10 also increases the throughput level by one level when the detected temperature of the temperature detecting element 32 drops to a temperature lower than the threshold temperature Tp by 10° C.

Table 6 illustrates the effects of the control of the third embodiment. Table 6 compares cases when the relationship between the pressurizing force and the productivity (PPM) is corrected by the threshold temperature in the measuring mode (Table 5) and when no correction is made (Table 2). In order to compare them under a condition in which the longitudinal shape of the nip portion is changed by a time-dependent change or the like, an imaginary longitudinal distribution of pressure is made experimentally by adjusting the pressurizing force of the pressurizing mechanism 9. The numerical values of productivity (PPM) are average values of numbers of heat-processed sheets per minute measured by transversely feeding 500 sheets of LTR size recording media whose width is narrower than a transverse feed size of an A4-size sheet and by which the increase of temperature of the non-sheet passing part is increased.

TABLE 6

| Pressurizing force (N) | 321 | 315 | 300 | 285 | 279 |
|---|---|---|---|---|---|
| Comparative Example (sheet/min) | 30 | 25 | 20 | 18 | 15 |
| Third Embodiment (sheet/min) | 30 | 30 | 30 | 30 | 30 |

As shown in Table 6, when the pressurizing force is small and the flow of heat of the longitudinal end part is smaller than that of the longitudinal center part of the nip portion, temperature of the heater 6 rises. If no correction is made by using a certain threshold temperature Tp at this time, the threshold temperature becomes excessive and the productivity (PPM) of the image forming apparatus 100 drops. However, the third embodiment is arranged such that the threshold temperature is corrected by the measuring mode, so that the optimum threshold temperature Tp is set in response to the quantity of transferred heat of the nip portion N and maximization of throughput is realized without dropping the productivity (PPM). The third embodiment also makes it possible to realize the maximization of throughput in forming images on small-size recording media without damaging the durability of the fixing belt 1 and the pressure roller 2 by accurately obtaining the temperature of the nip portion N. The third embodiment also makes it possible to evaluate the shape of the nip portion that varies depending on the time-dependent change and variation of quality of the pressure roller 2 composing the fixing apparatus 30 at the longitudinal center part and the longitudinal end part. Thus, the third embodiment makes it possible to accommodate the recent demand to improve productivity by realizing both the maximization of the throughput of the fixing apparatus 30 in feeding small-size recording media during which the temperature of the non-sheet passing part increases, and the suppression of the increase of the temperature of the non-sheet passing part.

A further advantageous effect is likely brought about by combining the controls of the third embodiment with the controls of the first embodiment. That is, it is possible to avoid such a case that the surface temperature of the fixing belt 1 exceeds the designed temperature at the moment when the detected temperature of the temperature detecting element 32 reaches the threshold temperature by immediately correcting the threshold temperature in increasing the pressurizing force of the longitudinal end part of the nip portion N in the first embodiment.

As described above, according to the third embodiment, the control portion 10 detects the shapes of the nip (flows of heat) at the longitudinal center part and the longitudinal end part of the nip portion N of the fixing apparatus and changes the threshold temperature that adjusts the throughput in response to the detected results. Accordingly, the third embodiment makes it possible to realize the maximization of the throughput in feeding small-size recording media in response to the condition of the nip that varies depending on the variation of the members and a period of use of the fixing apparatus.

Fourth Embodiment

In a fourth embodiment, a service man manipulates an unillustrated manipulation panel to execute the measuring mode in installing the image forming apparatus 100 or in replacing the member of the fixing apparatus 30 in the same manner with the case of the second embodiment. Then, the control portion 10 executes the measuring mode and evaluates the size relationship between the pressurizing force of the longitudinal center part and the pressurizing force of the longitudinal end part of the nip portion to obtain a control value of the pressurizing mechanism 9 and a threshold temperature of the control of suppressing the increase of temperature of the non-sheet passing part using the temperature detecting element 32. Then, the control portion 10 adjusts and equalizes the pressurizing force of the longitudinal center part with the pressurizing force of the longitudinal end part by reflecting this in the control value obtained in the measuring mode immediately to the pressurizing mechanism 9. The control portion 10 also controls the throughput by using the threshold temperature obtained in the measuring (control) mode in the same manner with the third embodiment in an image forming process thereafter.

A further advantageous effect is likely brought about by combining the first and third embodiments in the fourth embodiment.

It is noted that the embodiments described above may be carried out by another embodiment in which a part or whole of the structure of the embodiments described above is replaced with a substituting structure as long as the values for adjusting the pressures of the nip portion or the threshold temperatures are determined based on temperature information of the longitudinal center part and the longitudinal end part of the nip portion.

Accordingly, the embodiments may be carried out not only in the image heating apparatus in which the roller member is put into contact with the belt member, but also in an image heating apparatus in which a belt member is put into contact with a belt member or a roller member is put into contact with a roller member. The image heating apparatus includes not only the fixing apparatus that fixes a non-fixed toner image on a recording medium, but also a heat processing apparatus that heats and presses an already-fixed or semi-fixed image.

The image forming apparatus is not also limited to be the image forming apparatus using the intermediate transfer belt, and may be an image forming apparatus using a recording medium conveying belt or an image forming apparatus configured to transfer a toner image directly on a recording medium by sheet-by-sheet. The image forming apparatus is not also limited to be the tandem-type in which the plurality of photoconductive drums is disposed along the belt member, but may be one drum-type in which one photoconductive drum is disposed along a belt member. The present invention can be also carried out not only in a printer, but also in various uses such as various types of printing machine, copier, facsimile, multi-function printer, and others.

While the present invention has been described with reference to the exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2012-182939, filed on Aug. 22, 2012 and 2013-152091, filed on Jul. 22, 2013 which are hereby incorporated by reference herein in their entirety.

What is claimed is:

1. An image heating apparatus, comprising:

an endless belt member that comes in contact with an image surface of a recording medium;

a support structure configured to be irrotational, to support an inner side surface of the belt member, and to heat the belt member;

a roller member configured to come into contact with the belt member supported by the support structure and to form a nip portion;

a pressurizing mechanism configured to form the nip portion by generating a pressurizing force between the support structure and the roller member;

a first temperature sensor that detects the temperature of a longitudinal center part of the support structure;

a second temperature sensor that detects the temperature of a longitudinal end part of the support structure; and a control portion configured to execute a measuring mode in which the control portion detects the temperatures by the first and second temperature sensors in a process of changing the temperature of the nip portion heated by the support structure, and to generate control information reflecting the difference of pressurizing conditions of the longitudinal end part and the longitudinal center part of the nip portion based on detected results.

2. The image heating apparatus according to claim 1, wherein the control portion generates the control information in response to a difference of temperature increase amounts of the first and second temperature sensors within a predetermined time of the temperature increasing process of the nip portion in the measuring mode.

3. The image heating apparatus according to claim 2, wherein the pressurizing mechanism is configured to pressurize both end portions of at least either one of the support structure and the roller member and to adjust the difference between the pressurizing condition of the longitudinal end part and the pressurizing condition of the longitudinal center part of the nip portion by changing the pressurizing force to be applied to the both end portions; and wherein the control information includes a control value for adjusting the pressurizing mechanism to adjust the pressurizing force to be applied to the both end portions such that the relationship between the temperature increase amount of the first temperature sensor and the temperature increase amount of the second temperature sensor is adjusted to fall under a predetermined relationship.

4. The image heating apparatus according to claim 3, wherein the control value for adjusting the pressurizing mechanism is set to reduce the difference of the temperature increase amounts of the first and second temperature sensors.

5. The image heating apparatus according to claim 3, wherein the control portion adjusts the pressurizing force of the pressurizing mechanism based on the control value obtained in the measuring mode after a process for heating the recording medium is executed in the nip portion in succession of the temperature increasing process of the nip portion.

6. The image heating apparatus according to claim 1, wherein the control information includes a threshold temperature of a detected temperature of the second temperature sensor to restrict an increase of temperature of the longitudinal end part of the nip portion.

7. The image heating apparatus according to claim 2, wherein the control information includes a threshold temperature a detected temperature of the second temperature sensor to restrict an increase of temperature of the longitudinal end part of the nip portion.

8. The image heating apparatus according to claim 7, wherein the control portion increases the threshold temperature stepwise in response to an increase in a positive direction of a value of a difference obtained by subtracting a temperature increase amount of the first temperature sensor from a temperature increase amount of the second temperature sensor detected within a predetermined time in a process of increasing temperature of the nip portion.

9. The image heating apparatus according to claim 6, wherein the control portion decreases the a number of sheets to be processed per unit time in a heating process stepwise every time the detected temperature of the second temperature sensor reaches the threshold temperature in executing the process of heating the recording medium in the nip portion in succession to the process of increasing temperature of the nip portion.

10. The image heating apparatus according to claim 8, wherein the control portion decreases the number of sheets to be processed per unit time in a heating process stepwise every time the detected temperature of the second temperature sensor reaches the threshold temperature in executing the process of heating the recording medium in the nip portion in succession to the process of increasing temperature of the nip portion.

11. The image heating apparatus according to claim 1, wherein the control portion generates, as the control information, i) a control value of the pressurizing mechanism for adjusting pressurizing forces on the both end portions such that the relationship between a temperature increase amount of the first temperature sensor and a temperature increase amount of the second temperature sensor is adjusted to be a predetermined relationship, and ii) a threshold temperature for restricting an increase of temperature of the longitudinal end part of the nip portion with respect to a detected temperature of the second temperature sensor; and wherein the control portion adjusts setting of the threshold temperature by the threshold temperature obtained in the measuring mode, and returns the setting of the threshold temperature to an initial state when the pressurizing force of the pressurizing mechanism is adjusted by the control value obtained in the measuring mode.

12. An image heating apparatus, comprising:

a heating member configured to come in contact with an image surface of a recording medium and to heat the image surface;

a roller member that comes in contact with the heating member and forms a nip portion;

a first temperature sensor that detects the temperature of a longitudinal center part of the heating member;

a second temperature sensor that detects the temperature of a longitudinal end part of the heating member; and a control portion configured to detect temperatures of the nip portion by the first and second temperature sensors in a process of changing the temperature of the nip portion heated by the heating member, to evaluate whether a distribution of pressurizing force of the longitudinal center part of the nip portion is larger than that of the longitudinal end part in response to a gradient of temperature change of the first temperature sensor being larger than a gradient of temperature change of the second temperature sensor, and to evaluate whether the distribution of pressurizing force of the longitudinal center part of the nip portion is smaller than that of the longitudinal end part in response to a gradient of temperature change of the first temperature sensor being smaller than the gradient of temperature change of the second temperature sensor.

13. An image forming apparatus, comprising:

an image forming portion configured to form toner images at variable image intervals and to transfer the toner images on recording media;

an endless belt member configured to come in contact with an image surface of each recording medium;

a support structure configured to be irrotational, to support an inner side surface of the belt member, and to heat the belt member;

a roller member configured to come into contact with the belt member supported by the support structure and to form a nip portion through which the recording medium fed from the image forming portion passes;

a pressurizing mechanism configured to form the nip portion by pressurizing both end portions of at least either one the support structure and the roller member;

a first temperature sensor that detects the temperature of a longitudinal center part of the support structure;

a second temperature sensor that detects the temperature of a longitudinal end part of the support structure; and a control portion configured to detect temperatures of the nip portion by the first and second temperature sensors in a process of changing the temperature of the nip portion heated by the support structure and to generate control information reflecting a difference of pressurizing conditions of the longitudinal center part and the longitudinal end part of the nip portion based on the detected results.

* * * * *